US007458307B2

(12) United States Patent
Kussel

(10) Patent No.: US 7,458,307 B2
(45) Date of Patent: Dec. 2, 2008

(54) HYDRAULIC CONTROL FOR A LONGWALL SUPPORT

(75) Inventor: Willi Kussel, Werne (DE)

(73) Assignee: Tiefenbach Control Systems GmbH, Essen (DE)

( * ) Notice: Subject to any disclaimer, the term of this patent is extended or adjusted under 35 U.S.C. 154(b) by 449 days.

(21) Appl. No.: 11/259,995

(22) Filed: Oct. 26, 2005

(65) Prior Publication Data

US 2006/0042243 A1 Mar. 2, 2006

Related U.S. Application Data

(63) Continuation of application No. PCT/DE2004/000787, filed on Apr. 15, 2004.

(30) Foreign Application Priority Data

May 14, 2003 (DE) ..... 103 21 826

(51) Int. Cl.
*E21D 23/18* (2006.01)
*E21D 23/26* (2006.01)

(52) U.S. Cl. ..... 91/170 MP; 91/526

(58) Field of Classification Search ..... 91/170 R, 91/170 MP, 171, 526, 525

See application file for complete search history.

(56) References Cited

U.S. PATENT DOCUMENTS 4,306,822 A * 12/1981 Weirich et al. ..... 91/170 MP
4,657,443 A 4/1987 Blumenthal
4,679,489 A * 7/1987 Jasinski et al. ..... 91/171
6,282,893 B1 * 9/2001 Porter et al. ..... 60/477

FOREIGN PATENT DOCUMENTS

WO WO 02/068798 A1 9/2002

* cited by examiner

*Primary Examiner*—Michael Leslie
(74) *Attorney, Agent, or Firm*—Alston & Bird LLP

(57) ABSTRACT

A hydraulic control for a longwall support with a plurality of face support frameworks (1-3), which are adapted to be actuated in the sense of longwall support functions, in particular in the sense of the longwall support operations: robbing, advancing, and setting, comprises hydraulic control valves (8, 9) for each of the biasing elements, which are each arranged in close spatial relationship with the biasing elements, and subdivided into groups. Each group connects to a hydraulic pressure line (16), which extends over the longwall length of a plurality of face support frameworks, via a group connection line (18), which can be blocked by a group stop valve (20) as a function of the actuation of the control valves, specifically, when all control valves are not actuated and all biasing elements of the group are in a static state.

6 Claims, 2 Drawing Sheets

HYDRAULIC CONTROL FOR A LONGWALL SUPPORT

CROSS REFERENCE TO RELATED APPLICATION

The present application is a continuation of international application PCT/DE2004/000787, filed 15 Apr. 2004, and which designates the U.S. The disclosure of the referenced application is incorporated herein by reference.

BACKGROUND OF THE INVENTION

The invention relates to a hydraulic control for a longwall support. A hydraulic control of this type is disclosed in WO 02/068798 A1.

The invention relates to the hydraulic control for a plurality of face support frameworks. The face support frameworks are arranged along a coal seam. The coal seam is worked with the cutting device of a mining machine, for example, the cylindrical cutters of a coal cutting machine. The coal that has been dislodged by the cylindrical cutters of the coal cutting machine is loaded on a conveyor. The conveyor comprises a trough, which is subdivided into individual units (trough chutes). Each trough chute connects to a longwall support unit by a biasing element, typically a piston-cylinder unit. Each face support framework serves to support the longwall face. To this end, additional cylinder-piston units are used, which brace a base plate relative a roof plate, and which primarily also raise the coal face catcher at the front end of the roof plate that faces the coal seam, ahead of the approaching coal cutting machine, and subsequently lower it in front of the coal face. Additional operating elements and associated biasing elements are present.

BRIEF SUMMARY OF THE PRESENT INVENTION

The advanced characteristic feature of this hydraulic control consists in arranging the control valves for actuating the biasing elements of a face support framework not only in the region of the face support framework, but also on the same and even on the respective biasing element. No piping is needed between the control valve and the associated biasing element. The biasing element and associated control valves may be constructed as one structural unit, and in particular be tested before installation. Errors can be prevented when assembling control valves and biasing elements and when laying hoses between control valves and biasing elements. The risk of damage to piping is eliminated, which also reduces the danger of accidents significantly. In this connection, one needs to take into account that because of high pressures of more than 300 bars (4,351 psi), any leakage is also connected with the risk of serious injuries. Yet, the piping remains, which is needed in each face support framework for a connection between the control valves and the pressure line that extends over the length of the longwall (high-pressure line). Insofar it is a further object to reduce or eliminate the risk of leakages and injuries that are caused thereby.

The initially described hydraulic control is further developed in that groups of control valves are switched without pressure, when these control valves are in the zero position, i.e., when none of the control valves associated to this group is in a switched position, in which the high-pressure line and the biasing elements are connected. The solution provides for connecting the high-pressure line and the control valves of the group via a common group supply line, which includes a stop valve. With the use of this group stop valve, the group supply line will be blocked, when all biasing elements of the group are in a static state.

In one configuration of the invention, this static state is inquired from an electronic controller of the longwall support, which is associated to the group of control valves, and which releases actuating commands to the electromagnets of the control valves. When the control current that is drawn by this longwall support controller falls below a limit value or to zero, the stop valve is switched to its blocking position.

In an alternative configuration of the invention, the group of the control valves is connected by means of a common group return line to the longwall return line, and the hydraulic flow in the group return line is measured. When this hydraulic flow falls below a predetermined limit value or to zero, the stop valve will be switched to its blocking position.

In accordance with the invention, a plurality of control valves of a face support framework are combined to groups and respectively connected via a common group supply line and group return line to the longwall pressure line or the longwall return line. However, it is also possible to combine in this manner all control valves of a face support framework to a group. In this case, only one stop valve is associated with each face support framework with the advantage that in the static state of this face support framework, i.e., when no support functions are performed, the entire face support framework is switched to a pressureless state, so that a risk of bursting lines or hydraulic leakages is eliminated.

DETAILED DESCRIPTION

Figure 1:
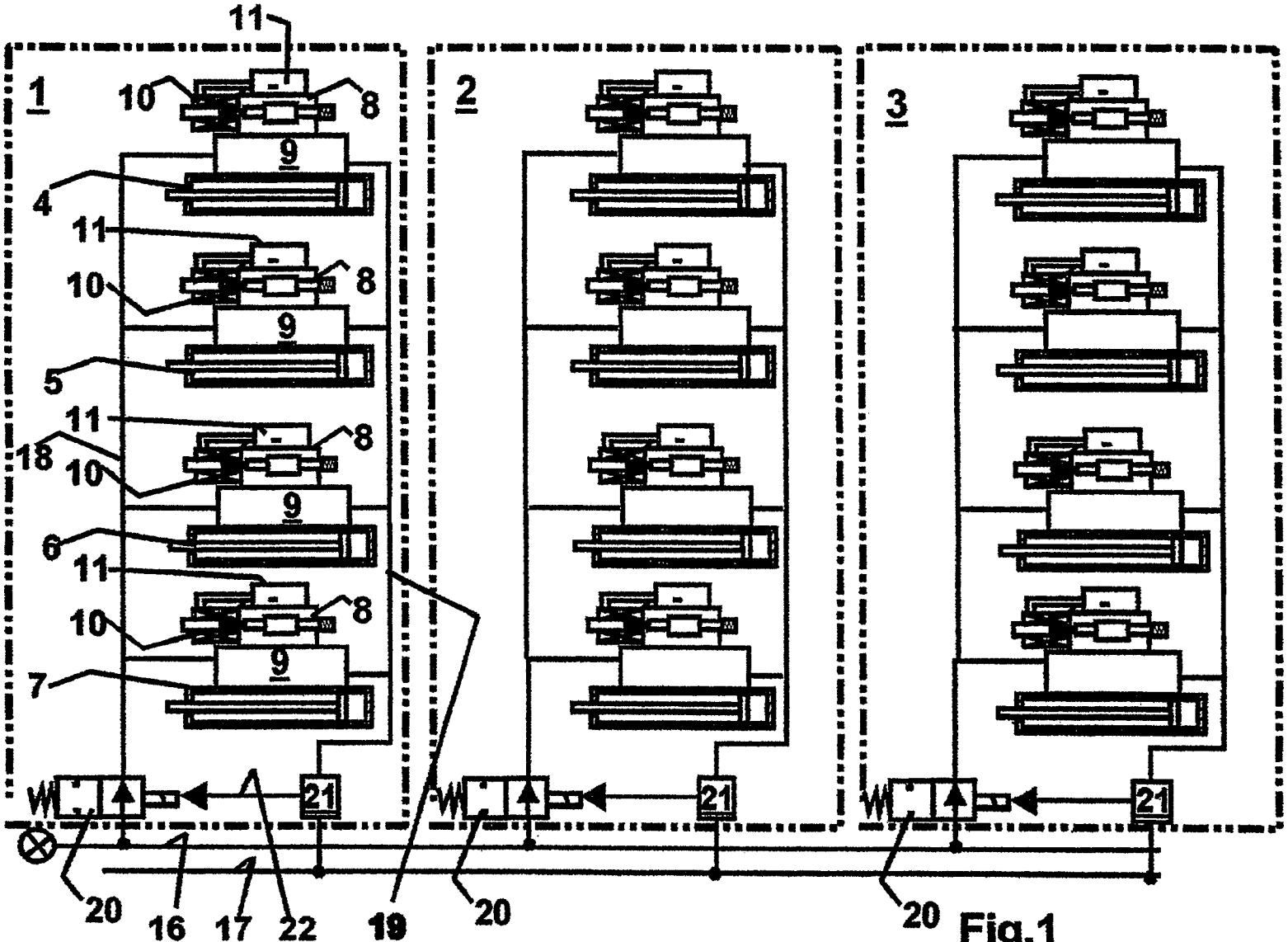
FIG. 1 is a schematic view of the hydraulic equipment for a plurality of groups of biasing elements with control valves and with a hydraulically actuated stop valve.
Figure 2:
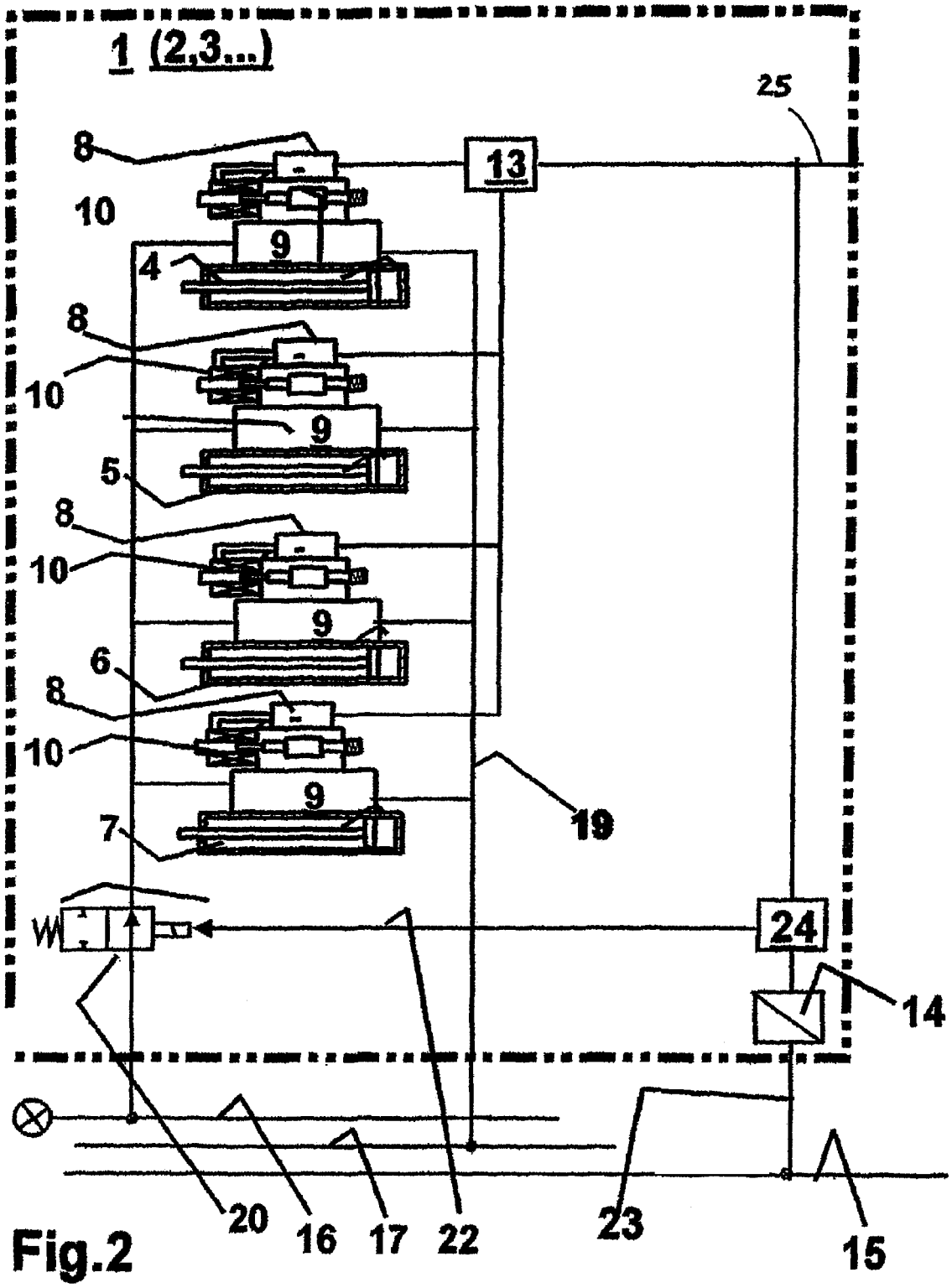
FIG. 2 is a schematic view of hydraulic equipment for a group of biasing elements with an electrically actuated stop valve.

FIG. 1 schematically illustrates three face support frameworks 1-3. Each face support framework includes biasing elements 4, 5, 6, 7 in the form of cylinder-piston units. Each biasing element is actuated by a pilot valve 8 and a thereby activated main control valve 9. To actuate the pilot valve 8, one uses a magnet 10 on the one hand and a microprocessor 11 on the other hand. The latter is controlled by a longwall support controller 13, which is shown in FIG. 2. A longwall support controller is associated with each face support framework. The longwall support controllers of a plurality of face support frameworks are interconnected by a common bus line 25. The commands for activating the above-described functions of the individual longwall supports can be triggered as a function of the advance of the mining machine, automatically, by hand in a central control room, by hand on one of the adjacent longwall support controllers, or on a portable hand set.

Associated with each longwall support controller 13 is a power supply unit 14, which transforms and rectifies the supply voltage of a line 15 to a voltage of 12 volts. This configuration as shown in FIG. 2 also applies to FIG. 1.

The biasing elements 4-7 each connect via their associated main control valves 9 to the longwall pressure line 16 on the one hand, and to the longwall return line 17 on the other hand. The longwall pressure line 16 carries a very high pressure of, for example, more than 300 bars (4,351 psi). The longwall pressure line 16 and the longwall return line 17 extend over the length of the longwall of a plurality of, in most cases all face support frameworks.

The units comprising pilot valve 8 and main control valve 9 are each flanged directly to their biasing element, and directly connected thereto without any piping. The units of pilot valve 8 and main control valve 9 connect to the longwall pressure line via a tap line (group connection line) 18. To connect the units of pilot valve 8 and main control valve 9 to the longwall return line 17, a group return line 19 common to the group is used. Interposed in the group connection line 18 is a stop valve 20. In its inactive position, the stop valve blocks the connection between the pressure line 16 and the group connection line 18. When actuated, it releases the passage.

In the embodiment of FIG. 1, integrated into the group return line 19 is a flowmeter 21. This flowmeter 21 determines the hydraulic flow to the longwall return line 17. The flowmeter 21 is adjusted such that it releases an actuating signal 22, when the hydraulic flow falls below a predetermined low limit value or to zero. The actuating signal 22 actuates the stop valve 20 and causes it to move to its blocking position. This means that upon actuation of one of the pilot valves 8, a connection is made between the supply line 18 and the return line 19, which leads to a volume flow, that the volume flow is measured by the flowmeter 21, and that the actuating signal 22 decays, which causes the stop valve 20 to close.

In a similar manner, it is possible to switch the group stop valve to be closed when the hydraulic flow falls below a limit value. To this end, a flowmeter is provided in the supply line. Not shown is that the stop valve is switched to it's flow position, when—as is described in the following—an electric actuating signal is waiting in the associated longwall support controller.

In the embodiment of FIG. 2, a current measuring device 24 is interposed in the connection line 23 between the power supply unit 14 and the longwall support controller 13, which measures the control current or the current consumption of the longwall support controller 13. This means that the current measuring device 24 is able to determine whether the longwall support controller 13 is used to release one of the longwall support functions. The current measuring device 24 is set up and adjusted such that upon exceeding a low limit value, an actuating signal 22 is released, which causes the stop valve 20 to switch to its opening position, and thus connects the entire longwall support system 1 (2, 3 . . . ) to the common longwall pressure line 16. In this manner, it is ensured that the entire hydraulic system of each individual longwall support, and in particular the hydraulic hose lines, which are susceptible to damage, are switched under no pressure, when the face support framework is in a static, unmoved state.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A hydraulic control for a longwall support comprising:

a plurality of face support frameworks configured to perform longwall support functions, wherein each of said plurality of face support frameworks comprises:

a plurality of hydraulically actuated biasing elements, each having a hydraulic control valve configured to connect a respective biasing element to a hydraulic longwall pressure line and a hydraulic longwall return line; and a longwall support controller for controlling each of said biasing elements to perform the longwall support functions;

wherein said hydraulic control valves of each support framework connect to said hydraulic longwall pressure line via a group connection line, which is configured to be blocked by a group stop valve when said control valves are not actuated.

2. The hydraulic control apparatus of claim 1, wherein said hydraulic control valves are attached to and are in hydraulic communication with their respective biasing elements without piping.

3. The hydraulic control apparatus of claim 1, wherein said group stop valve is configured to be switched to be closed when a control current of said longwall support controller falls below a limit value.

4. The hydraulic control apparatus of claim 1, wherein said group stop valve is configured to be switched to be closed when a hydraulic flow in said group connection line falls below a certain limit value.

5. The hydraulic control apparatus of claim 1, wherein said hydraulic control valves each connect to said hydraulic longwall return line via a common group return line, and wherein said group stop valve is configured to be switched to be closed when the hydraulic flow of said group return line falls below a limit value.

6. The hydraulic control apparatus of claim 1, wherein said longwall support controllers of said plurality of face support frameworks are interconnected by a common bus line.

* * * * *